United States Patent [19]

Lasurdo

[11] 4,450,636

[45] May 29, 1984

[54] PICTURE FRAME

[75] Inventor: Mary H. Lasurdo, Huntington Station, N.Y.

[73] Assignee: Susan Ann Trovato, Valley Stream, N.Y. ; a part interest

[21] Appl. No.: 373,836

[22] Filed: May 3, 1982

[51] Int. Cl.[3] ..... G09F 1/12

[52] U.S. Cl. ..... 40/152

[58] Field of Search ..... 40/153, 152, 154; 428/13

[56] References Cited

U.S. PATENT DOCUMENTS

| | | | |
|---|---|---|---|
| 377,567 | 2/1888 | Lowe | 40/153 |
| 476,357 | 6/1892 | Augir | 40/152.1 |
| 636,598 | 11/1899 | Turner | 239/556 |
| 828,984 | 8/1906 | Sweet | 40/152.1 |
| 1,279,091 | 9/1918 | Doolittle | 40/152 |
| 2,388,435 | 11/1945 | Puerner et al. | 40/152.1 |
| 2,749,636 | 6/1956 | Viglietta | 40/152 |
| 2,836,915 | 6/1958 | Cesak | 40/152.1 |
| 3,956,838 | 5/1976 | Gerrish | 40/154 |
| 3,981,091 | 9/1976 | Wiener, Jr. | 40/152 |
| 4,103,446 | 8/1978 | Maglott | 40/155 |
| 4,286,400 | 9/1981 | MacPherson | 40/154 |
| 4,296,561 | 10/1981 | Lawrence | 40/158 |

FOREIGN PATENT DOCUMENTS

| | | | |
|---|---|---|---|
| 2230270 | 12/1974 | France | 40/152.1 |

OTHER PUBLICATIONS

Publication–Simplicity House "The Romantic Dressing Room" Pattern 114, Copyright 1979.

*Primary Examiner*—Gene Mancene
*Assistant Examiner*—Wenceslao J. Contreras
*Attorney, Agent, or Firm*—Jay H. Maioli

[57] ABSTRACT

A picture frame having two principal elements, a planar backing board and a flexible annular material element formed substantially as two discs with a central aperture therein, the discs being attached to each other at their perimeters. Biasing means, such as an elastic band, are affixed to the cloth adjacent the apertures and are such that when the discs are placed over the backing board the elastic biases the apertures radially inwardly, thereby holding the outer element onto the backing board. In another embodiment a rigid element is substituted for the elastic element at the front of the frame, thereby defining a fixed shape through which the picture is presented. An additional embodiment involves a strip of spring-like material arranged adjacent to the central aperture of the disc-shaped materials in place of the circular portion of the disc-shaped material, a discontinuity is provided so that the free ends thereof may be spread apart and placed over the backing board and, upon releasing the ends, the outer element will close and appear as a continuous circular element.

6 Claims, 11 Drawing Figures

FIG. 1
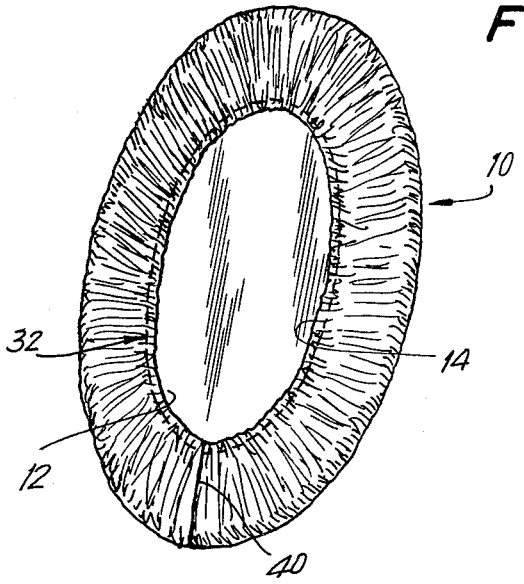
FIG. 2
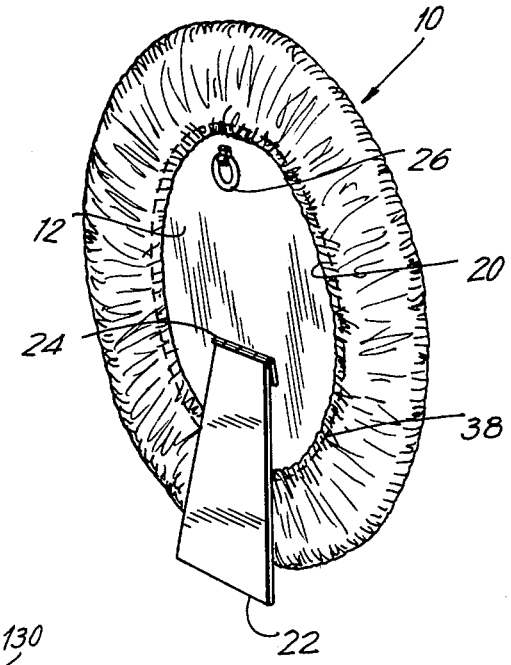
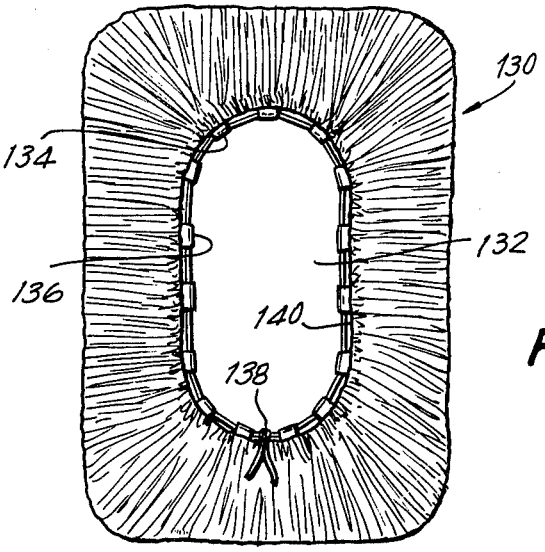
FIG. 11

FIG. 3
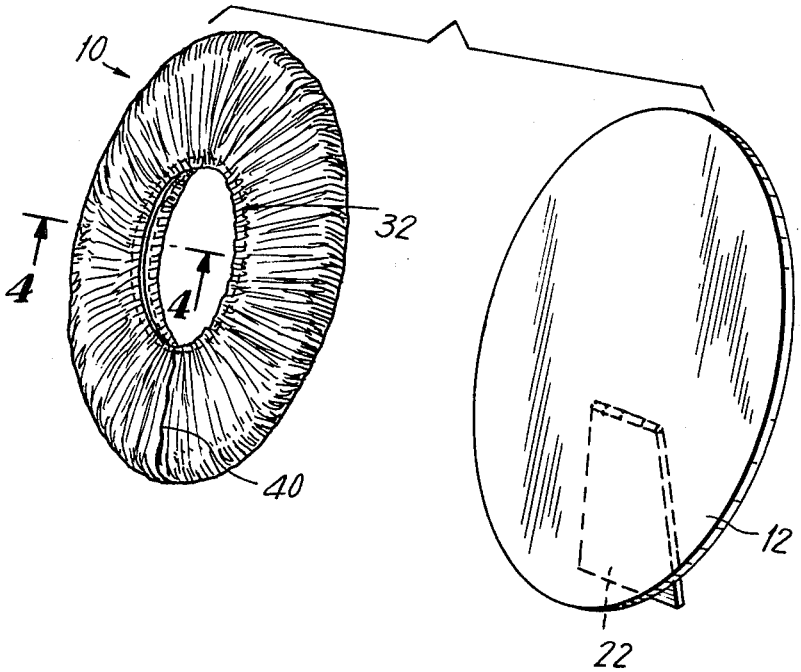
FIG. 4
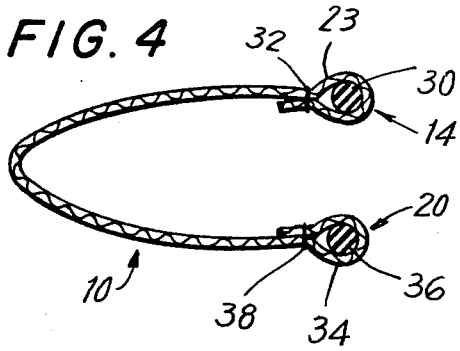
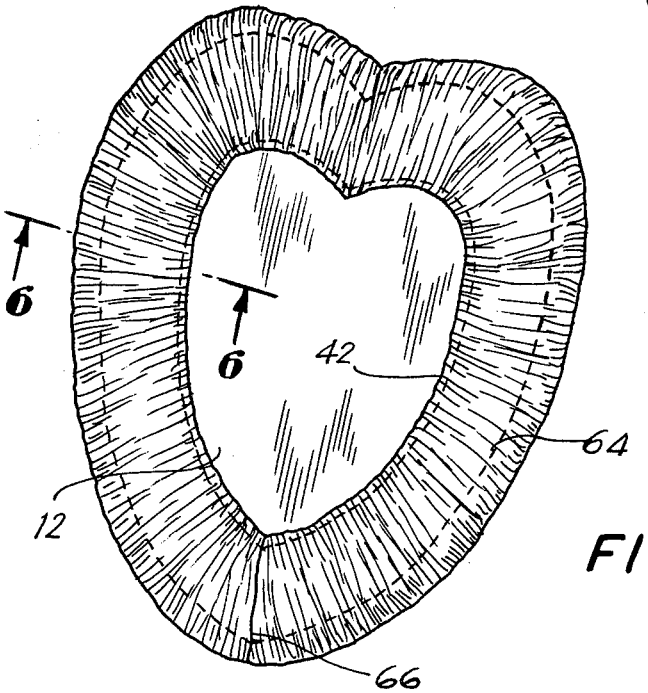
FIG. 5

FIG. 6
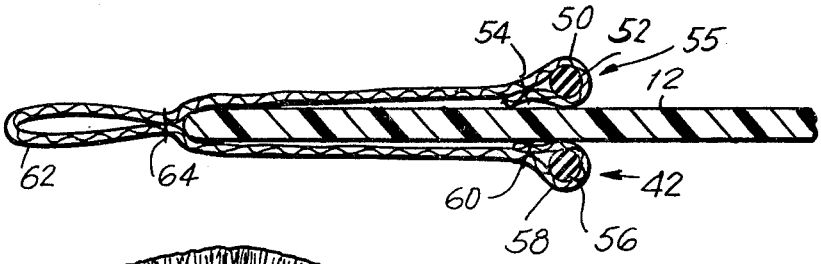
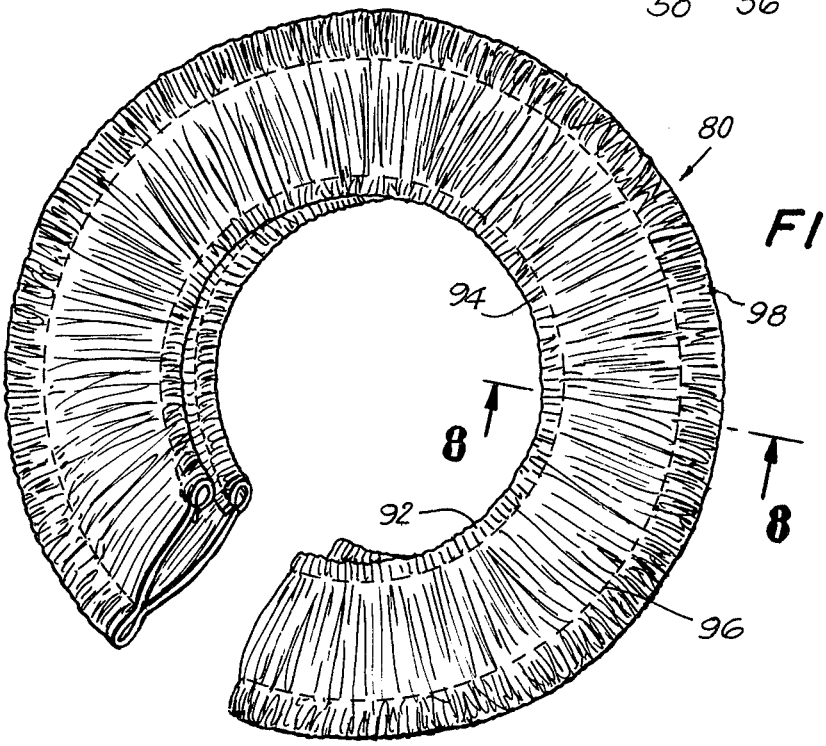
FIG. 7
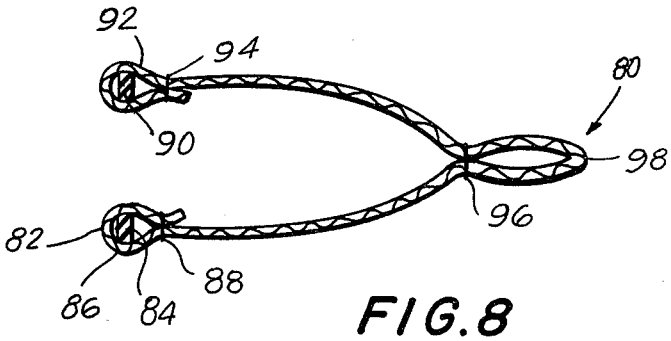
FIG. 8

PICTURE FRAME

BACKGROUND OF THE INVENTION

The present invention relates to picture frames in general and, more particularly, relates to picture frames wherein the border is flexible and easily removable from the backing board of the frame.

Conventional picture frames typically involve a sheet of glass, a rigid outer element defining the shape of the frame, and a rigid backing board including one or more spacers to retain the picture against the inside surface of the glass. Picture frames may be either hung on the wall by a hook or nail and a ring or wire arrangement or may be placed upright upon a flat surface by means of legs or supports and, typically, a single pivotable leg is provided to form a free standing structure in combination with the frame itself.

The outer element or border of the picture frame is generally made of wood or metal and usually has some decorative or eye-pleasing finish. Certain picture frames are known wherein the outer border is covered with fabric or leather or is formed of ceramic material. The known fabric-covered frames involve constructions that are very time consuming to make. Additionally, these fabric-covered frames can not be cleaned easily once they are assembled. Cleaning known fabric-covered frames involves an almost complete dissassembly of the frame that essentially destroys the frame.

All known picture frames require the above elements and the outer edges or borders of the frames are always rigid and define the shape and general appearance of the frame.

Picture frames can also be utilized to contain a piece of glass mirror, in which case the glass sheet and the picture are removed and the mirror substituted therefor.

While conventional picture frames have stayed essentially unchanged since their inception, there remains certain inherent drawbacks. For example, the size of the picture or photograph must correlate closely with the size of the frame. If the picture frame is larger than the picture to be placed therein, then a mat must be employed and the thickness of the glass and backing must be sufficient to retain the picture in the desired position against the glass. Otherwise, additional cardboard and backing material must be inserted so that the picture is retained firmly against the glass.

Also, the rigid nature of the frame itself and the typically rectangular shape limits to a large extent the decorative nature of the frame aside from the picture and, since wood and metal typically may take only a limited number of finishes, most picture frames tend to look pretty much the same.

SUMMARY OF THE INVENTION

The present invention provides a picture frame having only two principal elements, a rigid backing board and a flexible and resilient outer member, which in its extended or expanded state circumferentially surrounds the backing board leaving a central aperture for display of the picture. In its nonextended or relaxed state, the outer member is substantially annularly shaped with a central through aperture. This outer member has the shape generally similar to an unmounted automobile tire. This figure in mathematics is called a manifold, and in euclidean solid geometry it is called a catenoid of revolution.

The outer member is preferably made of fabric and has at least one resilient element formed integrally therewith. The fabric is initially dimensioned so that after attachment of the resilient element it may be expanded and placed, in an annular fashion, circumferentially around the edges of the backing board. The shape of the backing board generally defines the shape of aperture through which the picture is viewed.

In one embodiment the shape of the aperture in the flexible outer element is defined by an internally arranged rigid element so as to form any shape, such as a heart, a diamond, a triangle, or the like. In another embodiment the outer element is not continuous but is an open band that is biased to a substantially closed position by internally arranged elements. The band is then expanded and placed circumferentially around the backing board, thereby defining a central aperture through which the picture may be viewed.

As used herein the word biased is understood to mean acting in a spring-like fashion so as to cause some object or element to tend to be in a position other than that in which it would normally reside.

All of the embodiments of the present invention are arranged so that the aperture forming means is normally biased inwardly against the backing board. This inward pressure retains the picture or photograph at the location of the aperture. In this fashion the present invention does not require a mat, nor must the picture and frame be the same size; all that is required is that the picture be at least as large as the aperture.

By providing the backing board in any shape and the outer element of fabric or other suitable resilient flexible material, the backing board defines the outer shape of the frame, so that it may be either round, egg-shaped, elliptical, or any other suitable shape. Because the flexible outer element is arranged over the perimeter of the backing board, the shape of the backing board will determine the general shape of the aperture.

While a glass facing for the picture is not required in the present inventive frame, when displaying a photograph, a thin plastic cover sheet formed of suitable transparent material such a Mylar may be utilized.

Therefore, it is an object of the present invention to provide a picture frame which has only two principal elements and which employs a flexible annular outer element which is decorative and which retains the picture against the backing board.

It is another object of the present invention to provide a picture frame, wherein the outer element is flexible, has resilient properties, may be formed of fabric, and may be placed around the backing board by expanding the outer element and then permitting it to return to its original position around the edges of the backing board by the action of the resilient element.

It is a further object of the present invention to provide a two-piece picture frame assembly formed as an open band that is resiliently biased to a closed position, which may be expanded and placed circumferentially about the backing board forming a central aperture for display of the picture.

It is still further object of the present invention to provide a picture frame wherein the outer element is formed of fabric or other flexible material and has at least one resilient element biasing it in a radially inwardly direction and including a centrally disposed rigid element to define a specially shaped central aperture, such as a heart or a diamond.

The manner in which these and other objects are achieved by the present invention will be made clear from the following detailed description of the invention.

BRIEF DESCRIPTION OF THE DRAWINGS

FIG. 1 is a front perspective view of one embodiment of the present invention;

FIG. 2 is a rear perspective view of the embodiment of FIG. 1;

FIG. 3 is a front perspective view of the embodiment of FIG. 1 showing the two parts of the frame assembly separated;

FIG. 4 is a cross-sectional view of the embodiment of FIG. 3 taken through section lines 4—4;

FIG. 5 is a front elevational view of another embodiment of the present invention employing a rigid aperture defining insert;

FIG. 6 is a cross-sectional view of the embodiment of FIG. 5 taken through section lines 6—6;

FIG. 7 is a front perspective view of the open band embodiment of the present invention in an expanded position;

FIG. 8 is a cross-sectional view of the embodiment of FIG. 7 taken through section lines 8—8;

FIG. 11 is a front elevational view of another embodiment of the present invention having an adjustable aperture.

DETAILED DESCRIPTION OF THE INVENTION

Figure 9:
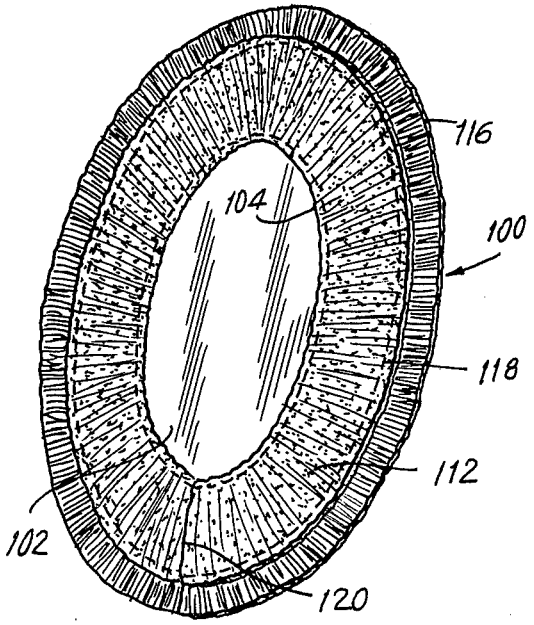
FIG. 9 is a front perspective view of a two-color embodiment of the present invention employing a decorative ruffle.

FIG. 1 is a perspective view of one embodiment of the present invention showing the outer annular fabric element typically at 10, and a portion of the backing board 12 showing through the centrally disposed aperture 14. Element 10 is formed of any suitably flexible material and may be fabric that is woven, nonwoven, or knitted, or may be any plastic fabric, or may be a paper-based fabric, or may be real or imitation leather or suede. The outer annular element 10 is shown in a partially expanded position in FIG. 1, as it is retained around the circumference of the backing board 12. In its unexpanded or relaxed state, not installed over a backing board, the outer element 10 is a hollow disc-shaped element having a central through aperture. More specifically, the outer element is a continuous surface having front and back portions each having mutually aligned central through apertures. The fabric outer element 10 is formed having internal, resilient, elastic elements that serve to retain the outer element onto the backing board 12 and define the aperture 14. This elastic element is affixed to the fabric, as will be seen in FIG. 4, and serves to bias the aperture radially inwardly. The use of the elastic elements also aids in maintaining the picture in the aperture 14. In the embodiment of FIG. 1, there are two such elastic elements, neither of which is seen in FIG. 1. Because the outer member 10 has a shape generally similar to an unmounted automobile tire, another aperture similar to aperture 14 is formed at the back of the picture frame.

In FIG. 2, the rear of the inventive frame structure of FIG. 1 is shown, and the aperture corresponding to aperture 14 of FIG. 1 is seen at 20. Aperture 20 is also formed by an internally arranged elastic member that causes the outer fabric element 10 to be biased radially inwardly, thereby drawing the outer element 10 around and over the edges of the backing board 12. In this embodiment, the backing board 12 is provided with a leg 22 hingedly attached at its upper end 24 to the backing board 12, so that it may be swung away from the plane of the backing board, thereby forming a stand to support the inventive frame in an upright position on a flat surface. Additionally, if desired, a ring 25 may be provided for hanging the inventive frame assembly on a wall. Nevertheless, the present invention is adaptable to any kind of stand or hanger.

Referring now to FIG. 3, the inventive frame is shown disassembled into its two principal elements, the outer annular fabric element 10 and the backing board 12. The support 22 is shown partilly in phantom. When the fabric element 10 is not arranged over the backing board 12 the elastic members, not seen in FIGS. 1, 2, or 3, cause the apertures 14 and 20 to be substantially reduced in diameter. Attendant to this diametric reduction, the overall diameter of the entire disc-shaped fabric element 10 is also decreased due to the biasing of the internal elastic members in a radially inward direction.

In order to show the arrangement of the internal elastic elements, which in this embodiment are continuous rubber cords or bands, but which could be formed of any suitable elastomeric material, a section is taken through the outer element 10 along lines 4–4 in FIG. 3. FIG. 4 shows such section through outer element 10, however, in the interest of clarity the fabric material is not shown cross hatched. FIG. 4 shows the edge of the front aperture 14, as well as the edge of the back aperture 20. In this embodiment of the invention, one edge 23 of the fabric is arranged around a front elastomeric band or ring 30, its inner surfaces are brought into contact and are fastened together by stitches, shown schematically at 32. This forms aperture 14. These stitches 32 are also seen in FIGS. 1 and 3. Similarly, the other edge 34 of the fabric is arranged to capture a second elastomeric band 36 and the inner surface of the fabric fastened together by stitches, shown schematically at 38. These stitches 38 are also seen in FIG. 2. The elastomeric elements 30 and 36 are formed as rings or continuous bands and, thus, in their relaxed or unexpanded state form apertures of relatively small diameter, as shown in FIG. 3, in relation to the size of the apertures when the outer element 10 is stretched around the circumference of the backing board 12, as shown in FIG. 1.

In this embodiment, the outer element 10 is formed from a flat rectangular strip of material. In forming the frame element as shown in FIGS. 1, 2, and 3, the narrow or short sides of the rectangular strip are first sewn together. This results in a continuous flat band of material having a single seam, this seam is shown in FIGS. 1 and 3 at 40. The fully extended diameter of this band is the upper limit on the size of the completed picture frame. Next the two edges of the bands are sewn around the two elastic bands. More specifically, front edge 28 is sewn around elastic band 30 and rear edge 34 is sewn around elastic band 32. The diameters or lengths of the elastic members 30 and 34 define the size of apertures 14 and 20 in the relaxed or unextended state, as shown in FIG. 3.

FIG. 5 shows another embodiment of the present invention, wherein a substantially rigid member is substituted in place of the front elastic element 30 of FIG.

4, to form a specially shaped front aperture 42. The shape of this front aperture is then determined by the rigid element and may be a heart shape, a diamond, or a square shape. In any event the shape of the front aperture 42 is not determined by the shape of the backing board 12. The rear resilient element, i.e., the element corresponding to 36 in FIG. 4 remains in this embodiment and the rear view of the embodiment of FIG. 5 is similar to that shown in FIG. 2, except that the rear aperture may be distorted somewhat from the shape of the backing board to correlate roughly with the form of the rigid element.

FIG. 6 is a cross-sectional view along lines 6—6 of FIG. 5 and, again, in the interest of clarity the material is not shown cross hatched. The rear elastomeric band is installed by arranging the rear edge 50 of the fabric around an elastic band 52 and stitching the material together, shown typically at 54. This forms a rear aperture 55 that corresponds to aperture 20 of FIG. 2. As stated above, in place of the front elastomeric band 30 a rigid or stiff metal element 56, or similar suitable rigid material, is inserted. The front edge 58 of the material is arranged around the rigid element 56 and its inner surfaces affixed together by stitches shown schematically at 60. This forms the fixed front aperture 42. FIG. 6 shows the backing board 12 in cross section with the inventive outer element arranged therearound. The shape of the fixed front aperture 42 is set by rigid element 56. Alternatively, the present invention contemplates the use of a rigid element that is malleable, so that the shape of aperture 42 can be altered by the user. Additionally, as a further decorative feature the embodiment of FIG. 5 is formed with a ruffle 62 formed by stitching the inner surfaces of the perihery of the fabric band together. These stitches are shown schematically at 64.

As in the embodiment of FIG. 1, this embodiment is formed from a rectangular strip of cloth with the short edges or sides sewn together. The seam resulting from this joining of the ends of the fabric band is shown in FIG. 5 at 66. Note that because of the addition of the ruffle 62 the fabric band from which the outer element is constructed would be generally wider than that of the embodiment of FIG. 1.

Referring to FIG. 7 another embodiment of the present invention is shown, wherein the fabric element corresponding to 10 in FIG. 1 is shown at 80. In this embodiment the continuous elastic bands 30 and 36 of FIG. 1 are replaced by metal or plastic strips that are formed as springs such that the ends of the band are biased toward a closed position during the relaxed state.

FIG. 8 is a cross-sectional view of FIG. 7 taken along section lines 8—8 and shows the front aperture edge 82 defined by the spring strip 84. Again, in the interest of clarity the material is not shown cross hatched. The front spring strip 84 is captured by the front edge of fabric 86 that is arranged around the strip 84 and stitched together, as shown generally at 88. The rear spring band 90 has the rear edge of material 92 arranged around it and stitched together typically at 94. The material stitched together at the periphery, shown typically at 96, to form a ruffle 98 if desired.

The embodiment of FIG. 7 is intended to be used in cooperation with the backing board 12 as in the above-described embodiments and, in order to arrange this outer element over the backing board, the ends of the strips are expanded to be further apart than shown in FIG. 8 and then slipped over the edges of the backing board and released to form the substantially closed outer element 80.

Referring now to FIG. 9 another embodiment of the present invention is shown. This embodiment is similar in appearance to that of FIG. 1, except that the construction differs somewhat. Specifically, the outer element 100 is arranged around a backing board 102 as in FIG. 1 and a front aperture 104 through which the picture is displayed is formed by an elastic element, not shown.

Figure 10:
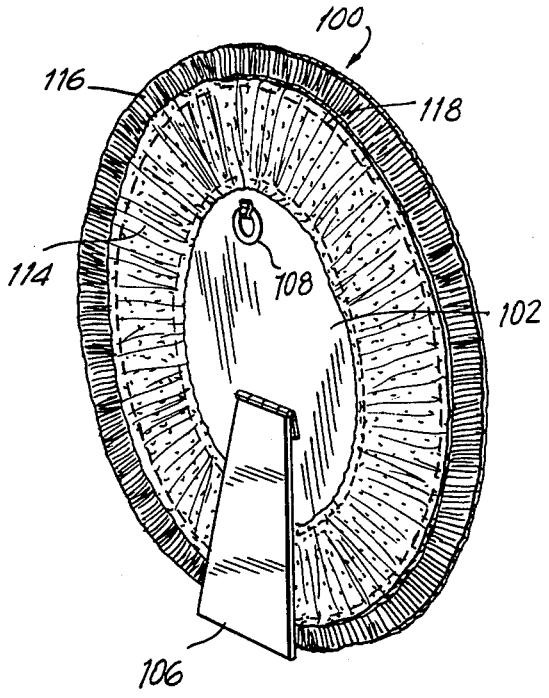
FIG. 10 is a rear perspective view of the embodiment of FIG. 9.

The rear of this embodiment is shown in FIG. 10 and again is similar to FIG. 2 in that the rear of backing board 102 is provided with a support by 106 and a hanging ring 108. A rear aperture 110 is again formed by an elastic element, not shown, affixed to the edge of the material forming the outer element 100.

In this embodiment the outer element 100 is not the same color on the front as on the back, i.e., it is reversible so that the frame presents a different color for decorating purposes. Specifically, the front surface 112 of the frame is of different color material than the back surface 114 of the frame. A ruffle 116 may be provided and this can be the same color as either material 112 or 114, or can be of an entirely different color.

When forming this embodiment, two different color rectangular flat strips are employed that are more narrow than the strip of the embodiment of FIG. 1. The strips are attached to each other along one of the long sides of the strip. When a ruffle 116 is desired the strips are not attached exactly edge to edge; the edge of one strip is attached to the other strip at a line inside of the outer edge. The distance from the edge of this attachment determines the width of the ruffle 116. The stitches attaching these two narrow strips are seen typically at 118. This results in a flat rectangular strip of material substantially identical to that with which the construction of FIG. 1 was commenced. Similarly, the short ends of this composite strip are stitched together to form a continuous flat band. This seam is shown at 120 in FIG. 9. The construction then is identical to that of FIG. 1, with the attachment of the front and rear elastic bands.

In using this embodiment, either material portion 112 or 114 can be arranged to face forward, thereby permitting the inventive frame to present two different colors or patterns. This two-color construction can also be used with any of the preceding variations of the basic inventive frame.

FIG. 11 shows yet another embodiment of the present invention, this one having an adjustable front aperture. As in the other embodiments there are two principal elements, a material outer element 130 and a planar backing board 132. The outer element 130 is formed again from a flat rectangular strip of fabric, with the short sides attached to form a continuous flat band. The rear aperture is formed by attaching an elastic band as in the other embodiments, however, the front aperture is made adjustable in size. This is accomplished by attaching loops, shown typically at 134, through which a cord or string 136 is passed. The ends of cord 136 are tied together in a bow 138. By pulling the ends of cord 136 to form a smaller circle, the effective size of the front aperture 140 is made adjustable to correspond with the size of the picture to be displayed. The size of rear aperture follows in an inverse relationship the size of the front aperture 140. Alternatively, in place of the loops 134 the invention contemplates the use of button holes, eyelets, or beaded lace, with the drawstring. All that is required is that the drawstring be slidingly retained and that its ends be available for altering the size of the aperture and for tying together.

It is understood of course that the foregoing is presented by way of example only and is not intended to limit the scope of the present invention, except as set forth in the appended claims. For example, in place of the elastic bands shown in FIG. 1, a shirring may be formed in the fabric adjacent the front and rear apertures, such shirring being formed with elastic thread. This also biases the apertures radially inwardly and holds the outer element firmly on the backing board, as well as retaining the picture against the backing board. Similarly, although the invention has discussed holding only one picture multiple pictures could be arranged in the aperture, to form a triptych, for example.

We claim:

1. Apparatus for displaying a picture, comprising:

a rigid planar backing board;

a flexible annular element having a central through aperture and being of a selected circumferential length for placement around the periphery of said backing board with said aperture being substantially centrally disposed on said backing board;

wherein said flexible annular element comprises first and second disc-shaped fabric portions, mutually attached substantially completely around the perimeters thereof, said first and second disc-shaped portions having first and second apertures formed therein, respectively, and said first and second apertures forming said central through aperture, and wherein said first disc-shaped fabric portion has a selected color and said second disc-shaped fabric portion has a second selected color, different from said first selected color;

means affixed to said flexible annular element for biasing the edges of said central through aperture radially inwardly, and for retaining said flexible annular element on said backing board, whereby a picture can be placed against said backing board and displayed through said central aperture.

2. The apparatus of claim 1, wherein said means for biasing comprises first and second continuous elastic rings affixed to the edges of said first and second concentric apertures, respectively.

3. Apparatus for use with a rigid planar board for displaying a picture, comprising:

a flexible element having a through aperture therein for circumferential arrangement around the edges of the rigid planar board and for covering a portion of the surface of the periphery of the planar board on both sides thereof wherein said flexible element comprises first and second disc shaped fabric portions, attached one to another at the perimeters thereof, said first and second disc shaped portions having first and second apertures centrally disposed therein, respectively;

biasing means affixed to said flexible element for biasing said aperture radially inwardly and for retaining said flexible element in covering contact with said portion of the surface of the periphery of the planar board and causing said aperture to be substantially centrally disposed on the planar board.

4. The apparatus of claim 3, wherein said biasing means comprises continuous elastic band means disposed adjacent said first and second apertures and affixed to said first and second disc shaped fabric portions.

5. The apparatus of claim 3, wherein said flexible element is formed having front and back portions with a space therebetween and having front and back apertures respectively, and aligned to form said through aperture and wherein said biasing means comprises first and second elastic band means arranged adjacent to said first and second apertures, respectively, and affixed thereto for biasing radially inwardly said first and second apertures.

6. A method for forming a picture frame of the kind having a planar rigid backing board, comprising the steps of:

forming a continuous flat band of fabric having a circumference at least as large as the circumference of the planar backing board including the steps of:

forming two flat rectangular strips of approximately the same size;

attaching the two strips together along a corresponding long side to form a composite wider flat rectangular strip of the same length;

attaching the short ends of the composite rectangular strip together to form the continuous flat band;

turning over the outer edges of the flat band of fabric;

inserting an elastic band in each of the turned over edges;

securing the respective ends of the elastic bands so as to draw the turned over edges inwardly into circles;

expanding the elastic bands; and placing the continuous band of fabric around the outer edges of the planar backing board to form a front space for displaying a picture therein.

* * * * *